US009986777B2

(12) United States Patent
Morgan

(10) Patent No.: US 9,986,777 B2
(45) Date of Patent: Jun. 5, 2018

(54) BALACLAVA HOOD SYSTEM

(71) Applicant: TATE TECHNOLOGY, LLC, Pacific Palisades, CA (US)

(72) Inventor: Jenny Tate Morgan, Pacific Palisades, CA (US)

(73) Assignee: TATE TECHNOLOGY, LLC, Pacific Palisades, CA (US)

( * ) Notice: Subject to any disclaimer, the term of this patent is extended or adjusted under 35 U.S.C. 154(b) by 5 days.

(21) Appl. No.: 14/772,749

(22) PCT Filed: Mar. 3, 2014

(86) PCT No.: PCT/US2014/019926

§ 371 (c)(1),
(2) Date: Sep. 3, 2015

(87) PCT Pub. No.: WO2014/137910

PCT Pub. Date: Sep. 12, 2014

(65) Prior Publication Data

US 2015/0374060 A1 Dec. 31, 2015

Related U.S. Application Data

(60) Provisional application No. 61/772,381, filed on Mar. 4, 2013.

(51) Int. Cl.
*A42B 1/00* (2006.01)
*A42B 1/20* (2006.01)
(Continued)

(52) U.S. Cl.
CPC ..... *A42B 1/203* (2013.01); *A42B 1/046* (2013.01); *A42B 1/08* (2013.01); *A42B 1/242* (2013.01); *A42B 3/046* (2013.01)

(58) Field of Classification Search
CPC ..... A42B 1/203; A42B 1/08; A42B 1/242; A42B 3/046; A42B 1/046
See application file for complete search history.

(56) References Cited

U.S. PATENT DOCUMENTS 5,390,367 A * 2/1995 Rush, III ..... A41D 13/018 2/413
5,546,609 A * 8/1996 Rush, III ..... A41D 13/018 2/413

(Continued)

OTHER PUBLICATIONS

PCT/US2014/019926 International Search Report & Written Opinion dated Jun. 26, 2014.

*Primary Examiner* — Khaled Annis
(74) *Attorney, Agent, or Firm* — Jeffer Mangels; Butler & Mitchell LLP; Brennan C. Swain, Esq.

(57) ABSTRACT

A disposable aspirated inflatable safety protection balaclava hood system and apparatus designed to protect the human head and neck from injury resulting from sports impacts with a crash sensor arrangement in which acceleration, angular, rotational, extension or flexion motion resulting from an impact force requires deployment of an apparatus protection device. The method embodies an inherent bladder airbag system that is deployed with resulting impact force on the sensor arrangement using an actuation mechanism and an inflation interconnected bladder system, or tube(s) resulting in release of the inert compressed inert gas in a cartridge actuation mechanism using a triggering mechanism, which is held in an interior pocket of the hood resulting in aspiration of the inflatable safety bladder protection hood.

14 Claims, 6 Drawing Sheets

(51) Int. Cl.

| | |
|---|---|
| ***A42B 1/04*** | (2006.01) |
| ***A42B 3/04*** | (2006.01) |
| ***A42B 1/08*** | (2006.01) |
| ***A42B 1/24*** | (2006.01) |

(56) References Cited

U.S. PATENT DOCUMENTS

| | | | | |
|---|---|---|---|---|
| 5,628,065 | A | 5/1997 | Austin | |
| 6,826,781 | B2 | 12/2004 | Lewis | |
| 8,127,373 | B1 | 3/2012 | Fodemski | |
| 2002/0100109 | A1* | 8/2002 | Hoop | A41D 13/0512 2/425 |
| 2004/0183283 | A1* | 9/2004 | Buckman | A41D 13/018 280/730.1 |
| 2005/0067816 | A1* | 3/2005 | Buckman | A41D 13/018 280/730.1 |
| 2006/0107952 | A1* | 5/2006 | Schlosser | A41D 13/018 128/202.19 |
| 2007/0075528 | A1* | 4/2007 | Makabe | A41D 13/018 280/730.1 |
| 2009/0239428 | A1* | 9/2009 | Berchten | A62B 33/00 441/80 |
| 2009/0254003 | A1* | 10/2009 | Buckman | A61B 5/1117 600/595 |
| 2012/0011642 | A1* | 1/2012 | Dainese | A41D 13/018 2/455 |
| 2013/0060168 | A1* | 3/2013 | Chu | A42B 3/046 600/595 |

* cited by examiner

BALACLAVA HOOD SYSTEM

FIELD OF THE INVENTION

This invention relates generally to a disposable aspirated inflatable safety protection balaclava hood system designed to protect the human head and neck from injury resulting from sports impacts with a crash sensor arrangement in which acceleration, angular, rotational, extension or flexion motion resulting from an impact force requires deployment of an apparatus protection device. The method embodies an inherent bladder airbag system that is deployed with resulting impact force on the sensor arrangement using an actuation mechanism and an inflation interconnected bladder system, or tube(s) resulting in release of the inert compressed inert gas in a cartridge actuation mechanism using a triggering mechanism, which is held in an interior pocket of the hood resulting in aspiration of the inflatable safety bladder protection hood. The invention also includes in the balaclava hood system breathable double fabric knit hood worn over the head and neck, a sensor arrangement arranged with specific characteristics around keys impact points on the head, a actuation mechanism and an inflation tube, a triggering mechanism, an inert compressed gas cartridge, an inflatable safety bladder system.

The method embodies an inherent bladder airbag system that is deployed with resulting impact force on the sensor arrangement resulting in release on an inert compressed gas cartridge actuation mechanism held in an interior pocket of the hood resulting in aspiration of the inflatable safety bladder protection hood.

BACKGROUND OF THE INVENTION

Traditional or conventional balaclava hoods are used and have primarily one element for function, or one function, which is for warmth in cold environments, whether they are for sports, any outdoor activity, or for working in the outdoors. Manufacturers' balaclava hoods typically cover some portion or all of the face and eyes, or have an open portal for the face using "wicking" material to keep sweat away from the human body/skin. They are designed for cold weather without bulk using a double-sided fabric that "wicks" the moisture away from the skin and circulates body heat.

An articulating body protective device for protection from impact-based injuries, especially relating to sports activities, is provided by a fabric outer balaclava hood element or garment and pound force impact force related elements, which are strategically provided in predetermined locations within the layers of the balaclava outer hood garment for protecting the human head from injuries related to impact during sports or athletic activities.

The cartridge actuation mechanism includes a triggering device that can be actuated to open the cartridge by means of a chemical charge in the cartridge inflator actuation system. The inflator sets off a chemical charge, producing an explosion of compressed inert gas, filling up the bladder airbag system. The actuation is in response to a compressive force of predetermined impact force or magnitude, and in doing so the inflator sets off the chemical charge. A compressed gas cartridge is held in an interior pocket of the balaclava hood system, specifically in the clavicle member of the hood system, and attached to an inflatable bladder airbag system. The compressed inert gas cartridge connects to the bladder airbag system through a cartridge actuation mechanism. The actuation mechanism is resultant of pound force of compressive pressure from impact force.

The impact sensor system embodies the ability to sense pound force whether it is resulting from just acceleration, or angular acceleration, or rotational acceleration. This impact sensor system embodies the ability to sense pound force thereby sending a signal to the actuation mechanism triggering the compressed inert gas cartridge to release the inert gas, which immediately and instantly inflates the bladder airbag system thereby protecting the neck and clavicle of the user or wearer. The impact force may be sensed from "contact" whether it is from a "contact surface" including, but not limited to: helmets worn by human wearers, contact with other humans not wearing helmets, and impact with other parts of the human body, such as, but not limited to: legs, shoulders, elbows, hands, wrists, knees, feet, ankles, shoes worn by the human, hips, and other body parts and the like, plus the impact force may be sensed from "contact" whether it is from a "contact surface" such as, but not limited to: the ground consisting of grass, dirt, man-made turf, such as astro turf, or synthetic turf used instead of grass, snow, ice, asphalt, clay, concrete, other surfaces and the like.

The balaclava hood member, in some instances, will exhibit a layered configuration that includes a soft comfortable double layer of wicking material, a strong, pliable and durable bladder system (formed out of some polymer, such as flexible plastic, including, but not limited to thermoplastics including polyethylene, polypropylene, polystyrene, polyvinyl chloride, and polytetrafluoroethylene), and a lead system attached and originating from the electrode sensor system distributed throughout the head and located in between the double layers of wicking material in the balaclava hood system, with the leads attaching to the actuation mechanism thereby triggering the release of the inert gas contained in the compressed inert gas cartridge that connects to the bladder airbag system through a cartridge actuation mechanism, with the inert gas release inflating the bladder airbag system, which is the resultant of pound force of compressive pressure from impact force to the human head. Suitable flexible yet resilient plastics used for the bladder airbag system using polyethylene, polypropylene, polystyrene, polyvinyl chloride, and polytetrafluoroethylene that is flexible, but durable for holding shape under impact conditions, excessive heat conditions, not losing its strength or shape. The inert gas cartridge system may have a cylinder shape and consist of, but not be limited to metals, plastics, screws, nozzles, seals, clamps, and other components, parts and materials not listed. The bladder airbag system, electronic sensor system, leads, inert compressed gas cartridge, balaclava hood system may be joined to one another in various different methods, such as mechanical connectors, stitching or sewing, adhesives, cements, glues, fusing techniques, and other materials or techniques not listed.

SUMMARY OF THE PREFERRED EMBODIMENTS

The following synopsis represents a summary of aspects of the invention to provide a basic understanding of the invention, and the purpose of the invention. This summary is just that to provide an overview of the invention, and is not intended to identify all key critical elements of the invention, or to define/describe the scope, capacity or opportunity of the invention. The summary simply provides some concepts of the invention in a general form, as an introduction to the comprehensive description outlined below.

Aspects of the invention pertain to hood, neck, and clavicle members and hood, neck and clavicle receiving devices, such as a balaclava hood system (i.e. balaclava hoods already manufactured principally to provide warmth to the head, face and neck of the user for athletics, and any other daily use where protection from the weather is required), which includes a hood member, a neck member, a clavicle member, which are all engaged with each other as one complete unit, engaged as a double layered moisture wicking system. The hood member may include electronic sensor system with leads or wires leading to the neck system which may include or define a cavity or void to house or hold an inflatable bladder system as a neck receiving device. The clavicle member may also include or define a cavity or void to house or hold an inflatable bladder system as a clavicle receiving device. The clavicle member may also include or define a cavity, void or pocket receiving device to house or hold a triggering device and a cartridge inflator actuation system. The hood member may also include or define a cavity or void designated for the face, and the neck member may also include or define cavities or voids to allow the user to pull through their hair.

Additional aspects of the invention relate to sample methods for providing body protection using a cartridge actuation mechanism includes a triggering device that can be actuated to open the cartridge by means of a chemical charge in the cartridge inflator actuation system, filling up the bladder airbag system.

Such methods may include athletic vests, auto airbags, as receiving members.

A disposable aspirated inflatable safety protection hood system: an article of a wicking balaclava/hood/mask/head-neck gaiter. A balaclava is a close-fitting garment covering the whole head and neck except for parts of the face, typically made of wool or other wicking materials for use in sports and daily application for protection from the elements of weather, or for warmth.

BRIEF DESCRIPTION OF THE DRAWINGS

Like numerals refer to like parts throughout the several views of the drawings.

DETAILED DESCRIPTION OF THE PREFERRED EMBODIMENTS

Figure 1:
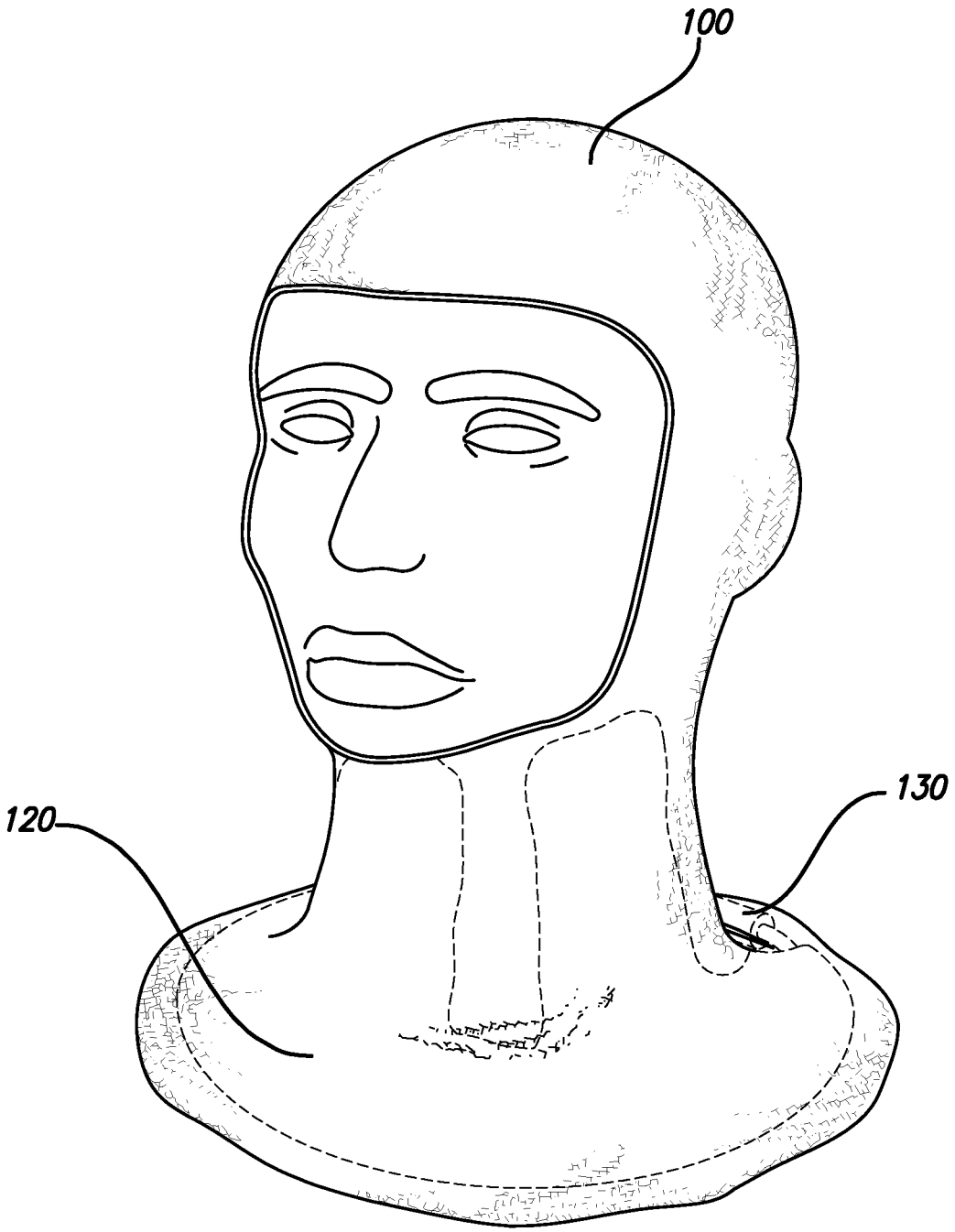
FIG. 1 illustrates an overview of an example front exterior view of the disposable balaclava hood system according to the embodiment of the invention, including the neck bladder system, including a clavicle bladder system.

The following description includes various examples of the invention, which are referenced and reference is made to the associated drawings, which form a part hereof, and in which are shown by way of illustration example systems. Also, the following description includes various examples of the invention, which are referenced and reference is made to the associated drawings, which form a part hereof, and in which are shown by way of illustration example environments and usage the invention may be employed. It is to be stated that other configurations, usages, aspects of use, parts, portions, example systems may be used and structural and functional modifications or alterations may be made without taking leave from the scope of the present invention. Terms, such as "around," "through," "top," bottom," "side," "above," "below," "underneath," "over," "clear," "transparent," etc. may be used to describe the invention, and the various examples, and example aspects, facets, features, elements of the invention, these terms are used herein as a matter of descriptors and for practicality and expediency based upon the example orientations as shown in the illustrations. Nothing in this specification should be construed as requiring a specific three-dimensional orientation of structures in order to fall within the scope of this invention.

The following outlines various sections, which are as follows: Terms; General Description of the balaclava hood system receiving devices including: An aspirated inflatable safety protection balaclava hood system and apparatus designed to protect the human head and neck from injury resulting from sports impacts with a crash sensor arrangement in which acceleration, angular, rotational, extension or flexion motion resulting from an impact force requires deployment of an apparatus protection device. The method embodies an inherent bladder airbag system that is deployed with resulting impact force on the sensor arrangement using an actuation mechanism and an inflation interconnected bladder system, or tube(s) resulting in release of the inert compressed inert gas in a cartridge actuation mechanism using a triggering mechanism, which is held in an interior pocket of the hood resulting in aspiration of the inflatable safety bladder protection hood.

Terms

The following terms are used in this specification of the field of the invention, and unless otherwise noted, these terms have the meaning below.

An "aspirated inflatable safety protection system" means any device that a user places on or over some portion of the human body.

"Balaclava hood system" means any type of hood worn on or over the human head, but is not limited to: all types of balaclava hood systems, hood system, hoods, whether the hoods are made out of natural or manmade cloth, natural or manmade knitted fabric, natural or manmade woven fabric, plastics, nylon, polymers. Hoods may protect the wearer from the environment, elements, physically, medically, etc.

"Inherent bladder airbag system" includes one or more portions of a airbag receiving device that extends as one whole or continuous unit throughout the neck and clavicle system of the bladder airbag system.

"Electronic sensor arrangement system" includes at least some portion of sensor receiving devices, some portion of a triggering mechanism, some portion of a configuration of sensors in the hood portion of the balaclava hood system, some portion of leads or wires connecting from the sensors leading to the actuation mechanism.

"Actuation or Triggering Mechanism" includes some portion of a receiving device that is located in the clavicle portion of the balaclava hood system, as part of the cartridge actuation mechanism, and that means some form of a mechanism that actuates or is triggered in response to the electronic sensor systems signals.

"Cartridge, or Canister" includes some portion of a cartridge that contains an inert gas, which includes some portion of an actuation mechanism, which when triggered releases the compressed inert gas contained in the cartridge.

"Inert compressed gas" means compressed gas contained in the cartridge, and inert gas includes some form of inert harmless gas, such as argon as used in auto airbags, or others used in today's market. The gases used are already approved for use in consumer products.

"Triggering mechanism" includes some portion of a receiving device connected to the sensor system and connected to the inert compressed gas cartridge actuation mechanism.

"Aspiration of the inflatable safety bladder protection hood" refers to the aspiration or inflation of the balaclava bladder airbag system with triggers releasing the inert compressed gas contained in the cartridge actuation mechanism coming from the electronic sensor arrangement system.

"Disposable" refers to the balaclava aspirated hood safety system to be disposed of and replaced once inflated after an impact force generated that is enough force to trigger the sensor system.

General Description of aspirated inflatable safety protection balaclava hood system including hood-receiving devices according to the invention.

Some aspects of the present invention relate generally to balaclava hood systems, to airbag protection devices, to protective equipment for safety in sports, and other uses. As shown in FIG. 1, which generally illustrates an example of the invention, and is described how the balaclava hood system would fit on the wearers head. The electronic sensor system may occupy one or more placements within the hood portion of the balaclava hood system. The electronic leads or wires may occupy one or more placements within the hood, neck and clavicle portion of the balaclava hood system. The inflatable safety bladder airbag system may occupy one or more placements within the hood, neck and clavicle portion of the balaclava hood system. The inert compressed gas canister actuation mechanism may occupy one or more placements within the hood, neck and clavicle portion of the balaclava hood system.

The balaclava hood system may be formed from a variety of comfortable wicking materials already in use in today's market, and may be formed with a variety of characteristics in the prior art.

The electronic sensor arrangement system may be formed from a variety of materials already in use in today's market, and may be formed with a variety of characteristics.

The inherent bladder airbag system may be formed from a variety of materials already in use in today's market, and may be formed with a variety of characteristics.

The actuation mechanism may be formed from a variety of materials already in use in today's market, and may be formed with a variety of characteristics.

The cartridge may be formed from a variety of materials already in use in today's market, and may be formed with a variety of characteristics.

The inert compressed gas may be formed from a variety of materials already in use in today's market, and may be formed with a variety of characteristics.

The triggering mechanism may be formed from a variety of materials already in use in today's market, and may be formed with a variety of characteristics.

Example Balaclava Aspirated Inflatable Safety Protection Hood Systems According to the Invention Aspects of the invention relate to safety systems in sports and relates to an aspirated inflatable safety hood system, or an aspirated inflatable safety protection system means any device that a user places on or over some portion of the human body. The balaclava hood safety system receiving device, (i.e. a balaclava hood system designed to protect the users head into neck area), which is an aspirated inflatable safety protection balaclava hood system and apparatus including a balaclava hood with an inner layer and an outer layer, the inner and outer layers including at least a hood member, a neck member, and a clavicle member, at least one member of the hood member including one or more apertures in the hood portion of the article of the balaclava hood system, and at least one member of the neck member including one or more apertures in the neck portion of the balaclava hood system, and at least one member of the clavicle member including one or more cavities in the neck portion.

The hood member portion of the balaclava hood contains the electronic sensor arrangement system, including one or more electronic sensors distributed throughout the hood, or head, portion of the balaclava hood system and are stitched, or some form of contact to maintain positioning in between the layers of materials of the balaclava hood. The electronic sensors will be distributed throughout the hood member portion of the balaclava system, i.e. at least over 65%, or at least over 75%, or at least over 85%, or even at least 95% of the hood member area. Additionally, the hood member may include one or more leads or wires extending therefrom the electronic sensor arrangement system. When the electronic sensors arrangement system, along with leads or wires is inserted, or attached with the best method of attachment, in the cavity between the two layers of wicking material in the balaclava hood member, the protrusions may extend vertically and laterally and/or upward or downward between the two material layers (i.e. the sensors will be as flat as possible, but will have some minor protrusions. The wires or leads will be also located in the cavity between the layers of wicking material in the balaclava hood and neck members, the protrusions may extend vertically and laterally and/or upward or downward between the two material layers (i.e. the leads will be as flat as possible, but will have some minor protrusions. The bladder airbag system will be also located in the cavity between the layers of wicking material in the balaclava neck and clavicle members, the protrusions may extend vertically and laterally and/or upward or downward between the two material layers (i.e. the bladder airbag system will be as flat as possible, but will have some minor protrusions. The cartridge actuation mechanism will be also located in the cavity between the layers of wicking material in the balaclava neck into the clavicle members, the protrusions may extend vertically and laterally and/or upward or downward between the two material layers (i.e. the cartridge actuation mechanism will be as oval, or round, or flat, and as small as possible, but will have some protrusions.

The electronic sensor actuation system of an example embodiment of the invention may occupy a significant portion of the entire hood and neck members of the balaclava hood system, i.e. at least 50%, or at least 60%, or at least 70%, or at least 80%, or even at least 90% of the hood and neck member of the balaclava hood system and region or area. The electronic leads or wire system of an example embodiment of the invention may occupy a significant portion of the entire hood, neck and clavicle members of the balaclava hood system, i.e. at least 50%, or at least 60%, or at least 70%, or at least 80%, or even at least 90% of the hood, neck and clavicle member of the balaclava hood system and region or area. The bladder airbag system of an example embodiment of the invention may occupy a significant portion of the entire neck and clavicle members of the balaclava hood system, i.e. at least 50%, or at least 60%, or at least 70%, or at least 80%, or even at least 90% of the neck and clavicle member of the balaclava hood system and region or area. The cartridge actuation mechanism system of an example embodiment of the invention may occupy a significant portion of the neck and clavicle members of the balaclava hood system, i.e. at least 50%, or at least 60%, or at least 70%, or at least 80%, or even at least 90% of the neck and clavicle member of the balaclava hood system and region or area. The cartridge actuation mechanism may also further include a trigger mechanism connecting the leads to the cartridge containing the inert compressed gas. The electronic sensor actuation system may also further include connections to the leads or wires. The electronic sensor actuation system may also further include a method to attach the electronic sensors to the material layers, and which will reside in between the two layers of wicking material of the balaclava hood system. The cartridge may also have a method of attaching or connecting beyond being located in a pre-designed, sewn, or constructed pocket to hold the cartridge. The cartridge when inserted in the cavity or void designed in the balaclava hood system, specifically in the clavicle member of the hood system, may have one or more protrusions that may extend laterally and vertically, may have depth, may have height, and may be in three dimensional form.

As already described, the one or more protrusions included in the hood member, the neck member and the clavicle member of the balaclava hood system as an example of the embodiment of the invention, all of which may extend laterally, vertically, may have depth, may have height, and may be in three dimensional form.

Also as noted, the one or more protrusions included in the hood member, as an example of the embodiment of the invention, may include one or more electronic sensors oriented in between the two layers of wicking material of the balaclava hood system, while not visible will be noted due to the protrusions extending vertically, horizontally, having depth, having height and being in three dimensional form.

Also as noted, the one or more protrusions included in the hood member and neck member, as an example of the embodiment of the invention, may include one or more wires or leads oriented in between the two layers of wicking material of the balaclava hood system, while not visible will be noted due to the protrusions extending vertically, horizontally, having depth, having height and being in three dimensional form.

Also as noted, the one or more protrusions included in the neck member and the clavicle member, as an example of the embodiment of the invention, may include one or more bladder airbag systems oriented in between the two layers of wicking material of the balaclava hood system, while not visible will be noted due to the protrusions extending vertically, horizontally, having depth, having height and being in three dimensional form.

Also as noted, the one or more protrusions included in the clavicle member, as an example of the embodiment of the invention, may include one or more cartridge actuation mechanism oriented in between the two layers of wicking material of the balaclava hood system, while not visible will be noted due to the protrusions extending vertically, horizontally, having depth, having height and being in three dimensional form.

Also as noted, the one or more apertures included in the neck member, as an example of the embodiment of the invention, may include one or more apertures oriented protruding from the two layers of wicking material of the balaclava hood system, and are visible from the exterior and the interior of the balaclava hood system and may extend vertically downward or may extend laterally sideways in the neck member.

The bladder airbag system may be formed of a variety of materials and/or include a variety of features or element to alter or adjust characteristics of the bladder airbag receiving device. For example, the pliable and durable bladder system may be formed out of some polymer, such as flexible plastic, including, but not limited to thermoplastics including polyethylene, polypropylene, polystyrene, polyvinyl chloride, and polytetrafluoroethylene.

The bladder airbag system may be formed of a variety of materials and/or include a variety of features or element to alter or adjust characteristics of the bladder airbag receiving device. For example, the pliable and durable bladder system may be formed out of some polymer, such as flexible plastic, including, but not limited to thermoplastics including polyethylene, polypropylene, polystyrene, polyvinyl chloride, and polytetrafluoroethylene.

The electronic sensor system may be formed of a variety of materials and/or include a variety of features or element to alter or adjust characteristics of the electronic sensor system receiving device.

The cartridge actuation system may be formed of a variety of materials and/or include a variety of features or elements to alter or adjust characteristics of the cartridge actuation system. This may be an off-the shelf cartridge actuation system utilized in other products.

Example Methods of Providing and Using Aspirated Inflatable Safety Protection Hood Receiving Device Systems According to Examples of the Invention.

Additional aspects of the invention include methods of providing and methods of using balaclava hood systems.

For example, to insert the cartridge inflator actuation mechanism system, wherein the cartridge contains compressed inert gas, and wherein the cartridge contains a trigger mechanism; to insert the impact crash electronic sensor arrangement including leads distributed/situated throughout the hood member; the neck member including one or more apertures; to insert the bladder airbag system at least a portion of the balaclava hood system may be removed or separated between the two wicking layers of material where each of the noted component parts above will be inserted.

To insert the cartridge inflator actuation mechanism system, wherein the cartridge contains compressed inert gas, and wherein the cartridge contains a trigger mechanism into the balaclava hood system, at least a portion of the clavicle member of the balaclava hood system, may be removed or separated between the two wicking layers of material where each of the noted component parts above will be inserted.

To insert the impact crash electronic sensor arrangement including leads distributed/situated throughout the hood member; the neck member including one or more apertures into the balaclava hood system, at least a portion of the hood, neck and clavicle members of the balaclava hood system, may be removed or separated between the two wicking layers of material where each of the noted component parts above will be inserted.

To insert the to insert the bladder airbag system into the balaclava hood system, at least a portion of the neck and clavicle members of the balaclava hood system, may be removed or separated between the two wicking layers of material where each of the noted component parts above will be inserted.

One or more protrusions extending from the cartridge inflator actuation mechanism system, wherein the cartridge contains compressed inert gas, and wherein the cartridge contains a trigger mechanism, and may detachably engage one or more aspects of the entire aspirated inflatable safety protection balaclava hood system and apparatus including a balaclava hood.

One or more protrusions extending from the impact crash electronic sensor arrangement including leads distributed/situated throughout the hood member; the neck member including one or more apertures, and may detachably engage one or more aspects of the entire aspirated inflatable safety protection balaclava hood system and apparatus including a balaclava hood.

One or more protrusions extending from the bladder airbag system at least a portion of the balaclava hood system, and may detachably engage one or more aspects of the entire aspirated inflatable safety protection balaclava hood system and apparatus including a balaclava hood.

The balaclava hood system receiving device when worn independently or with/underneath a safety helmet, including the electronic sensor system, the leads or wires, the bladder airbag system, and the compressed gas cartridge actuation mechanism may not present the or a wearer with an abnormal feeling of fit, comfort, or the like. Optimally, the invention will be worn with a safety helmet for sports.

Specific examples of the invention and the structures according to the examples of the invention are described in greater detail below in "C" "Specific Examples of the Invention." The reader of the invention should be aware that these specific examples and structures are set forth simply t illustrate the invention, and they should not be construed as limiting the invention.

Specific Examples of the Invention

The various figures in the application illustrate examples of an Aspirated Inflatable Safety Protection Hood Receiving Device System and product. The balaclava hood used for warmth and other various uses in today's markets is used as a base shape or design in the examples of the invention. When the same reference number is used and appears in one or more drawings, then that reference number is used consistently throughout in this specification and the drawings to refer to the same or similar parts.

Figure 3:
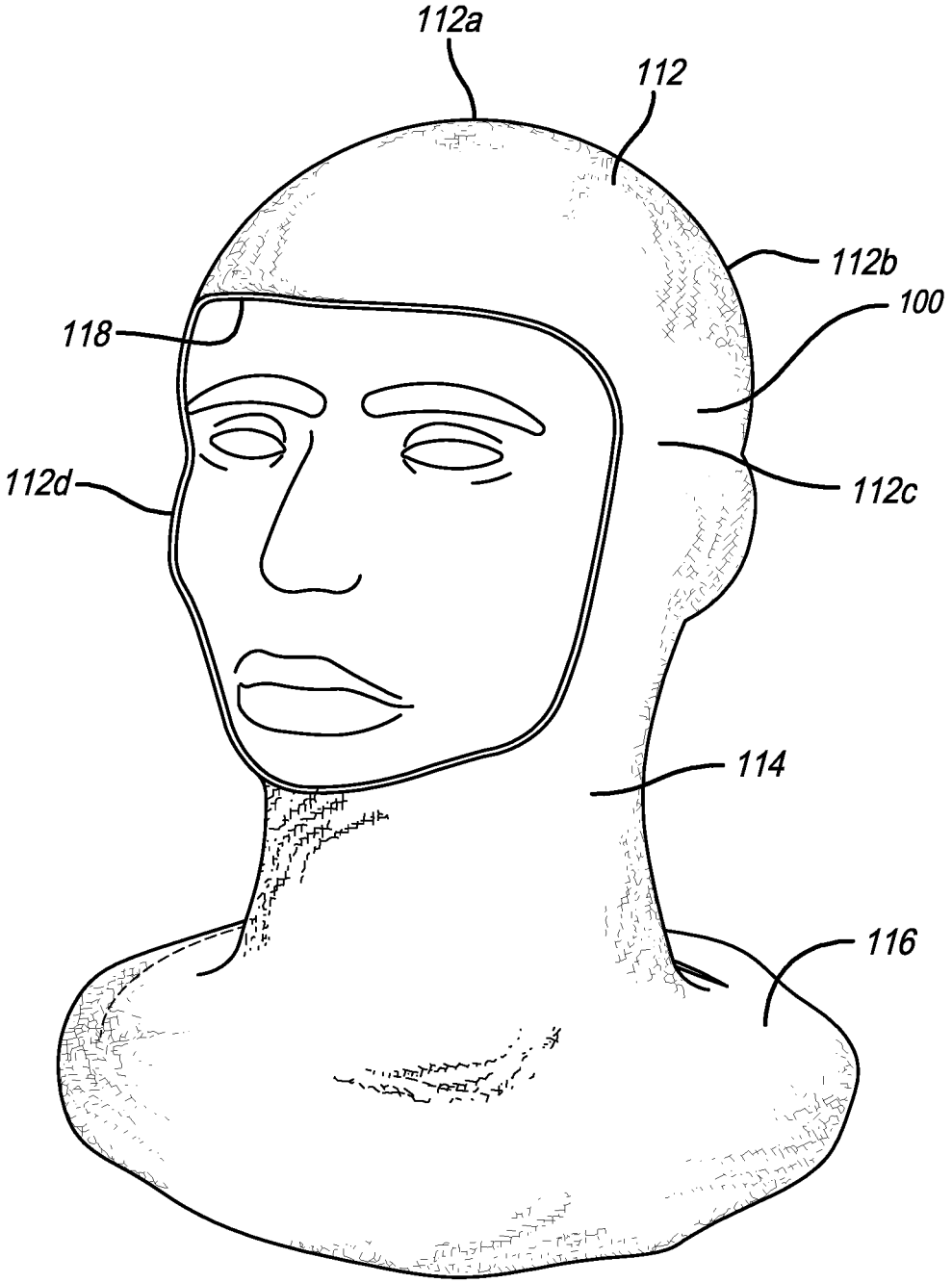
FIG. 3 illustrates an example of the exterior of the disposable balaclava hood system, including a neck portion, a hood portion, a clavicle portion.

An overall description, as described above, generally illustrates a front exterior view of the example of the invention in which this invention relates generally to a disposable aspirated inflatable safety protection balaclava hood system 100 designed to protect the human head and neck from injury resulting from sports impacts with a crash sensor arrangement 110 in which acceleration, angular, rotational, extension or flexion motion resulting from an impact force requires deployment of an apparatus protection device. The method embodies an inherent bladder airbag system 120 that is deployed with resulting impact force on the sensor arrangement 110 connecting using wires or leads 170 using an actuation mechanism 130 (the actuation mechanism or system 130 is in electrical communication with the sensor arrangement or system 110) and an inflation interconnected bladder system 120, or tube(s) resulting in release of the compressed inert gas in a cartridge actuation mechanism 130 using an actuation or triggering mechanism 150, which is held in an interior pocket 160 of the hood resulting in aspiration of the inflatable safety bladder 120 protection hood. The invention also includes in the balaclava hood system breathable double fabric knit hood 100 worn over the head and neck, a sensor arrangement 110 arranged with specific characteristics around keys impact points on the head, a actuation mechanism 110 and an airbag bladder inflation system 120, a triggering mechanism 150, and an inert compressed gas cartridge 130. As shown in FIG. 3, the hood or hood member 100 includes a head portion 112 (with a crown 112*a*, back 112*b*, left side 112*c* and right side 112*d*), a neck portion 114, a clavicle portion 116 and a front opening 118 defined therethrough that is configured to receive a face of a wearer when worn.

A disposable aspirated inflatable safety protection balaclava hood system 100 and apparatus including a balaclava hood 100 with an inner layer and an outer layer, the inner and outer layers including at least a hood member, a neck member, and a clavicle member, at least one member of the hood member including one or more apertures 180 in the hood portion of the article of the balaclava hood system, and at least one member of the neck member including one or more apertures 180 in the neck portion of the balaclava hood system, and at least one member of the clavicle member including one or more cavities in the neck portion.

The method embodies an inherent bladder airbag system 120 that is deployed with resulting impact force on the sensor arrangement 110 resulting in release on an inert compressed gas cartridge 130 and actuation mechanism 150 held in an interior pocket 160 of the hood resulting in aspiration of the inflatable safety bladder protection hood 120.

More specifically, FIG. 1 illustrates the outer layer of the double wicking layer of the disposable balaclava aspirated safety protection hood system 100, and shows using dotted lines the inflatable safety bladder protection system 120, and also using dotted lines the inert gas canister 130.

Figure 2:
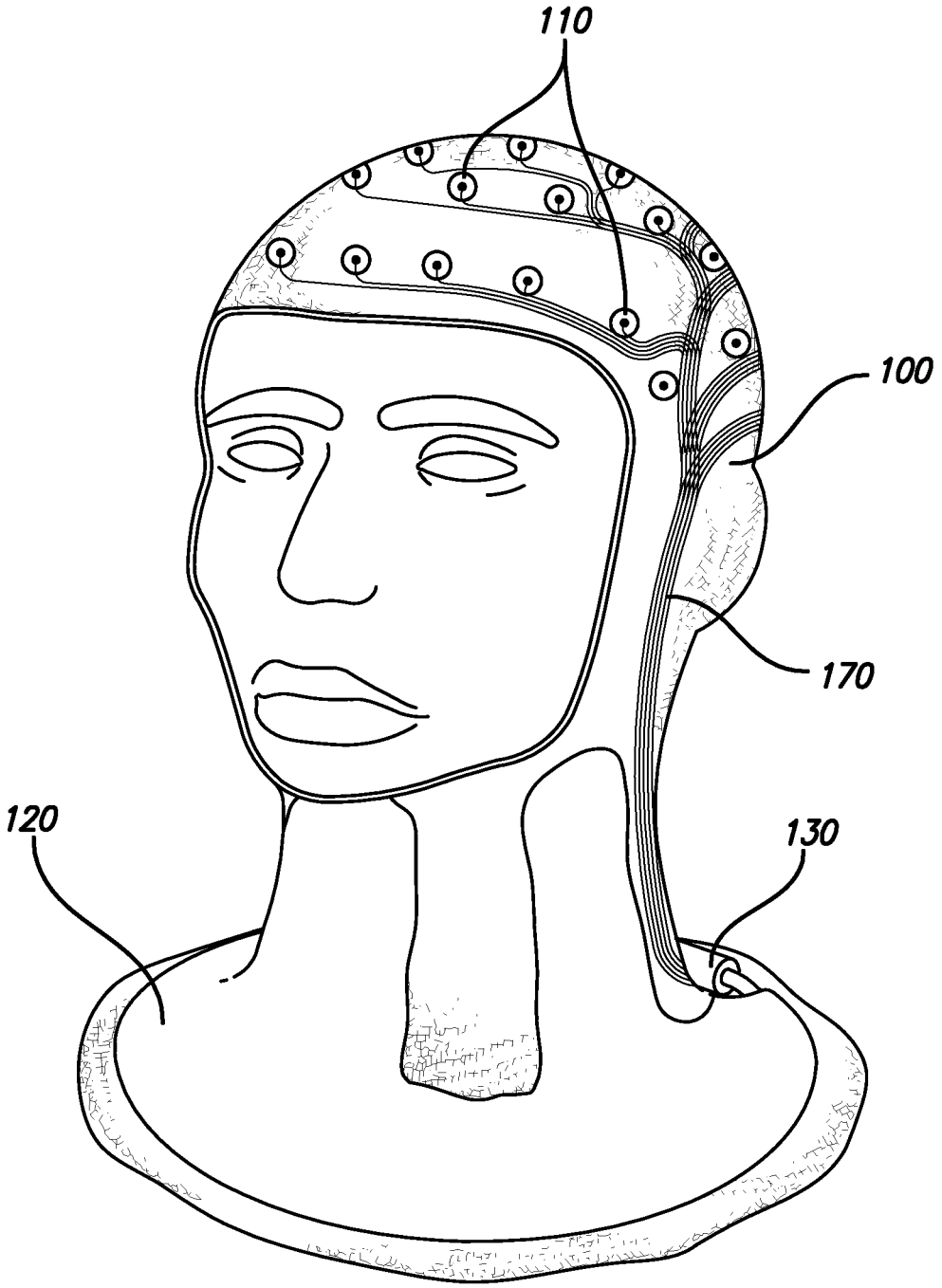
FIG. 2 illustrates an example of the disposable balaclava hood system, including a hood system including a cavity in the hood system for electronic leads and wires; including a neck system including a cavity for a bladder airbag system; including a clavicle system including a cavity or pocket for a triggering device including a cartridge inflator actuation system; illustrates an example of the wires connecting to the cartridge inflator actuation system; illustrates an example of the cavity of the neck system for the wires; illustrates an example of the cavity in the neck system for the bladder airbag system; illustrates an example of the cavity in the clavicle system for the bladder airbag system.

More specifically, FIG. 2 schematically illustrates an interior or in between the two wicking layers of material view of an example of a balaclava hood system 100 including a cavity for the insertion of the electronic sensor system 110 with the attached leads or wires 170 connecting to the cartridge 130 and the actuation system 150. As illustrated the electronic sensors, leads or wires are drawn using solid lines to show as in between the two layers of the wicking balaclava hood system in accordance with at least some examples of the invention. FIG. 2 also illustrates view of the example of the crash sensor arrangement 110 in which acceleration, angular, rotational, extension or flexion motion resulting from an impact force requires deployment of an apparatus protection device. The method embodies an inherent bladder airbag system 120 that is deployed with resulting impact force on the sensor arrangement 110 connecting using wires or leads 170 using an actuation mechanism 150 to the inert gas canister 130, and an inflation interconnected bladder system 120, or tube(s) resulting in release of the inert compressed inert gas in a cartridge actuation mechanism 130 using a actuation or triggering mechanism 150.

More specifically, FIG. 3 schematically illustrates the exterior view of the front of the example of a balaclava hood system 100.

Figure 4:
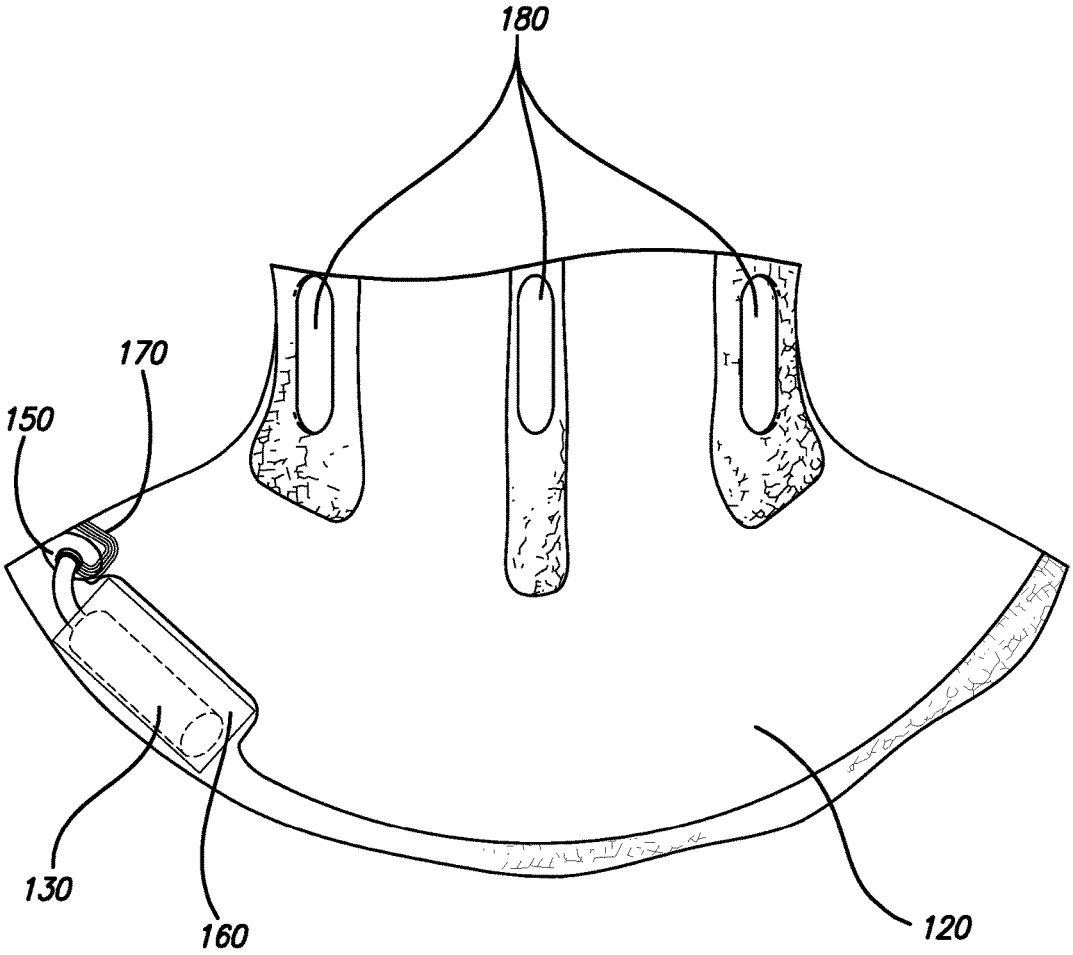
FIG. 4 illustrates an example of the balaclava hood system, including the cavity for the triggering device including a cartridge inflator actuation system; illustrates an example of the cavities or void in the neck system for allowance of pulling through hair.

More specifically, FIG. 4 schematically illustrates a partial sectional view of e back of an example of a balaclava hood system 100 including a partial view of the cavity for the insertion of the inherent bladder airbag system 120. As illustrated the inherent bladder airbag system 120 are drawn using a solid line to show with one layer of the wicking balaclava hood system and the second layer removed, peeled back in accordance with at least some examples of the invention. Additionally, the partial view illustrates the attached leads or wires 170 connecting to the actuation system 150 connected to the inert gas cartridge or canister 130. As illustrated the electronic sensors (which can be arranged in rows), leads or wires are drawn using a solid line to show with one layer of the wicking balaclava hood system and the second layer removed, peeled back in accordance with at least some examples of the invention. The inert gas cartridge or canister is shown using dotted lines, as it appears in the example of a balaclava hood system 100 including a cavity or pocket for the insertion of the cartridge actuation system 130 connected to the trigger mechanism 150, which is held in an interior pocket 160 of the hood resulting in aspiration of the inflatable safety bladder 120 protection hood in accordance with the invention because the actuation system 130 is in fluid communication (via a conduit 119) with the bladder 120. Furthermore, as shown in FIG. the bladder 120 includes a clavicle portion 122, a neck portion 124 and a plurality of chambers 126 extending upwardly from the clavicle portion 116 of the hood member 100 to the neck portion 118 of the hood member 100. The clavicle portion 122 of the bladder 120 is ring shaped. The actuation system 130 is positioned on the clavicle portion 116 of the hood member 100.

Figure 5:
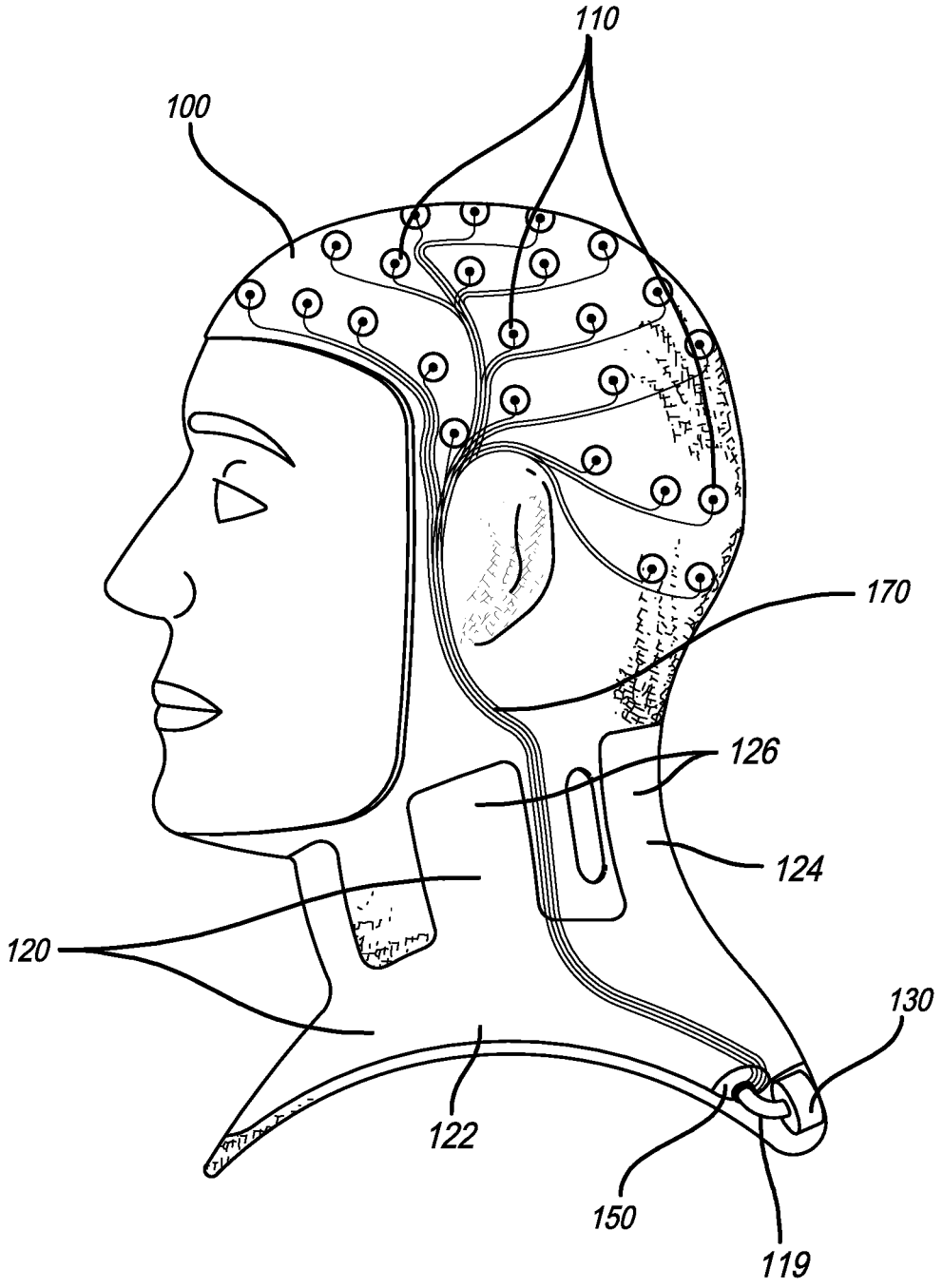
FIG. 5 illustrates an example of the side view of the balaclava hood system, including a hood system including a cavity in the hood system for electronic leads and wires; including a neck system including a cavity for a bladder airbag system; including a clavicle system including a cavity or pocket for a triggering device including a cartridge inflator actuation system; illustrates an example of the wires connecting to the cartridge inflator actuation system; illustrates an example of the cavity of the neck system for the wires; illustrates an example of the cavity in the neck system for the bladder airbag system; illustrates an example of the cavity in the clavicle system for the bladder airbag system.

More specifically, FIG. 5 schematically illustrates a side view of an example of a balaclava hood system 100 including a side interior view of the example of the invention with the outer layer peeled back of the wicking material that embodies an inherent bladder airbag system 120 that is deployed with resulting impact force on the sensor arrangement 110 connecting using wires or leads 170 using an actuation mechanism 130 and an inflation interconnected bladder system 120, or tube(s) resulting in release of the inert compressed inert gas in a cartridge actuation mechanism 130 using a actuation or triggering mechanism 150, which is held in an interior pocket 160 of the hood resulting in aspiration of the inflatable safety bladder 120 protection hood. The invention also includes in the balaclava hood system breathable double fabric knit hood 100 worn over the head and neck, a sensor arrangement 110 arranged with specific characteristics around keys impact points on the head, a actuation mechanism 110 and a airbag bladder inflation system 120, a triggering mechanism 150, and an inert compressed gas cartridge 130.

A disposable aspirated inflatable safety protection balaclava hood system 100 and apparatus including a balaclava hood 100 with an inner layer and an outer layer, the inner and outer layers including at least a hood member, a neck member, and a clavicle member, at least one member of the hood member including one or more apertures 180 in the hood portion of the article of the balaclava hood system, and at least one member of the neck member including one or more apertures 180 in the neck portion of the balaclava hood system, and at least one member of the clavicle member including one or more cavities in the neck portion.

The method embodies an inherent bladder airbag system 120 that is deployed with resulting impact force on the sensor arrangement 110 resulting in release on an inert compressed gas cartridge 130 and actuation mechanism 150 held in an interior pocket 160 of the hood resulting in aspiration of the inflatable safety bladder protection hood 120.

Figure 6:
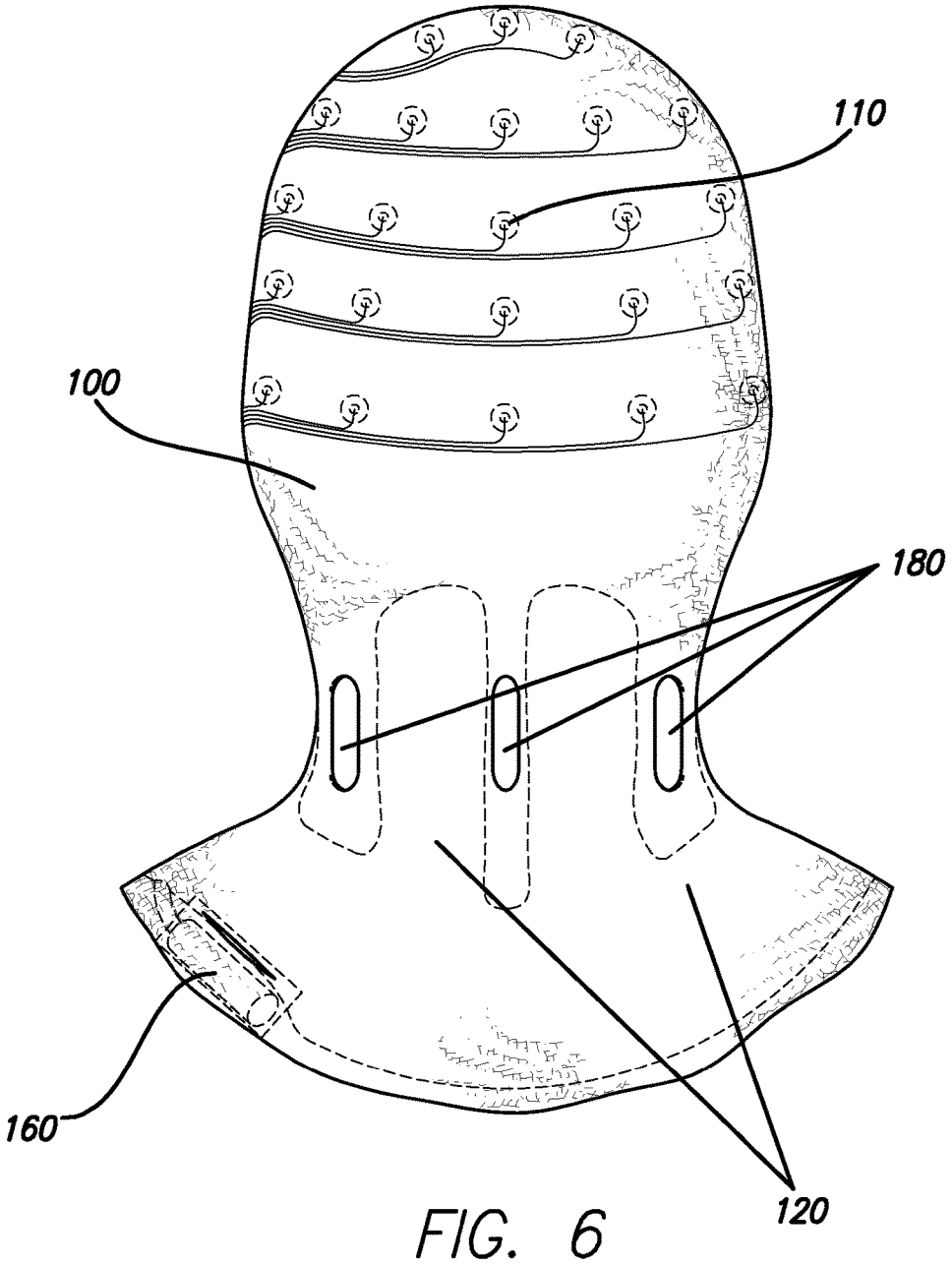
FIG. 6 illustrates an example of the balaclava hood system, as shown in between the two layers of wicking materials, including a hood system including a cavity in the hood system for electronic leads and wires; including a neck system including a cavity for a bladder airbag system; including a clavicle system including a cavity or pocket for a triggering device including a cartridge inflator actuation system; illustrates an example of the wires connecting to the cartridge inflator actuation system; illustrates an example of the cavity of the neck system for the wires; illustrates an example of the cavity in the neck system for the bladder airbag system; illustrates an example of the cavity in the clavicle system for the bladder airbag system.

More specifically, FIG. 6 schematically illustrates a complete exterior back or rear view of an example of a balaclava hood system 100 including a cavity for the insertion of the method embodies a section of the inherent bladder airbag system 120 shown with dotted lines that is deployed with resulting impact force on the sensor arrangement 110, also shown with dotted lines connecting using wires or leads using an actuation mechanism and an inert gas cartridge, and an inflation interconnected bladder system 120 shown using dotted line, or tube(s) resulting in release of the inert compressed inert gas in a cartridge using a triggering mechanism, which is held in an interior pocket 160 of the hood illustrated using dotted lines resulting in aspiration of the inflatable safety bladder protection hood in accordance with the invention.

Conclusion

There may be many modifications to the specifically described structures, systems, and methods of the invention may take place without departing from this invention. As an example, while the invention has been specifically described with respect to specific examples including preferred modes of carrying out the invention, those skilled in the art will appreciate that there may be numerous variations, combinations, and permutations of the above described systems and methods. Furthermore, various specific structural features included in the examples merely represent examples of structural feathers that may e included in some examples of structure according to the invention. Furthermore, with respect to the methods, many variations in the method steps may take place, the steps may be changed in order, various steps or features may be added changes, or omitted, etc., without departing from the invention. Thus, the reader should understand that the spirit and scope of the invention should be construed broadly as set forth in the appended claims.

What is claimed is:

1. A balaclava hood system comprising:

a hood member to be worn under a helmet that includes a head portion, a neck portion and a clavicle portion, and wherein the hood member includes a front opening defined therethrough that is configured to receive a face of a wearer when worn, a sensor system that includes a plurality of sensors positioned on the head portion of the hood member, an actuation system in electrical communication with the sensor system, a bladder positioned on at least one of the neck and clavicle portion of the hood member, wherein the bladder is in fluid communication with the actuation system, wherein when the sensor system senses a predetermined force, the actuation system inflates the bladder; wherein the hood member is made of a soft material.

2. The balaclava hood system of claim 1 wherein the hood member is made of a wicking material.

3. The balaclava hood system of claim 2 wherein the hood member includes an inner layer and an outer layer, and wherein the plurality of sensors are positioned between the inner and outer layers.

4. The balaclava hood system of claim 3 wherein the bladder is positioned between the inner and outer layers.

5. The balaclava hood system of claim 1 wherein the actuation system is positioned on the clavicle portion of the hood member.

6. The balaclava hood system of claim 1 wherein the bladder includes a clavicle portion and a neck portion, wherein the bladder includes a plurality of chambers extending upwardly from the clavicle portion of the hood member to the neck portion of the hood member.

7. The balaclava hood system of claim 6 wherein the clavicle portion of the bladder is ring shaped.

8. The balaclava hood system of claim 7 wherein the hood member includes at least a first aperture extending therethrough, wherein the first aperture is positioned circumferentially between two chambers.

9. The balaclava hood system of claim 3 wherein the plurality of sensors includes sensors positioned on a crown of the head portion, sensors positioned on a back of the head portion, sensors positioned on a left side of the head portion and sensors positioned on a right side of the head portion.

10. The balaclava hood system of claim 7 wherein the plurality of sensors are arranged in rows.

11. The balaclava hood system of claim 9 wherein the actuation system is in electrical communication with the sensor system via a plurality of leads, and wherein the leads are positioned between the first and second layers.

12. A balaclava hood system comprising:

a hood member to be worn under a helmet that includes a head portion, a neck portion and a clavicle portion, wherein the hood member includes an inner layer and an outer layer, and wherein the hood member includes a front opening defined therethrough that is configured to receive a face of a wearer when worn, wherein the inner and outer layers are made of a wicking soft material, a sensor system that includes a plurality of sensors positioned between the inner and outer layers, wherein the plurality of sensors includes sensors positioned on a crown of the head portion, sensors positioned on a back of the head portion, sensors positioned on a left side of the head portion and sensors positioned on a right side of the head portion, an actuation system in electrical communication with the sensor system via a plurality of leads, wherein the leads are positioned between the first and second layers, and wherein the actuation system is positioned on the clavicle portion of the hood member, a bladder positioned on the neck portion and the clavicle portion of the hood member, wherein the bladder is in fluid communication with the actuation system, wherein the bladder includes a ring shaped clavicle portion and a neck portion, wherein the bladder includes a plurality of chambers extending upwardly from the clavicle portion to the neck portion, and wherein the bladder is positioned between the inner and outer layers, wherein when the sensor system senses a predetermined force, the actuation system inflates the bladder.

13. The balaclava hood system of claim 12 wherein the hood member includes at least a first aperture extending therethrough, wherein the first aperture is positioned circumferentially between two chambers.

14. The balaclava hood system of claim 13 wherein the plurality of sensors are arranged in rows.

* * * * *